US010952931B2

(12) United States Patent
Garcia-Naveiro et al.

(10) Patent No.: US 10,952,931 B2
(45) Date of Patent: Mar. 23, 2021

(54) EXCHANGEABLE BALLOON GASTROJEJUNOSTOMY TUBE

(71) Applicant: Children's Hospital Medical Center of Akron, Akron, OH (US)

(72) Inventors: Reinaldo Garcia-Naveiro, Peninsula, OH (US); Todd Ponsky, Peninsula, OH (US)

(73) Assignee: Children's Hospital Medical Center of Akron, Akron, OH (US)

( * ) Notice: Subject to any disclaimer, the term of this patent is extended or adjusted under 35 U.S.C. 154(b) by 68 days.

(21) Appl. No.: 16/180,809

(22) Filed: Nov. 5, 2018

(65) Prior Publication Data

US 2019/0133890 A1 May 9, 2019

Related U.S. Application Data

(60) Provisional application No. 62/581,326, filed on Nov. 3, 2017.

(51) Int. Cl.
*A61J 15/00* (2006.01)

(52) U.S. Cl.
CPC ..... *A61J 15/0049* (2013.01); *A61J 15/0015* (2013.01); *A61J 15/0069* (2013.01)

(58) Field of Classification Search
CPC ..... A61J 15/0015; A61J 15/0049; A61J 15/0069; A61J 15/0034; A61J 15/0038; A61J 15/0042; A61J 15/0046
See application file for complete search history.

(56) References Cited

U.S. PATENT DOCUMENTS

| | | | | |
|---|---|---|---|---|
| 4,758,219 | A | 7/1988 | Sacks et al. | |
| 5,720,734 | A | 2/1998 | Copenhaver et al. | |
| 6,290,265 | B1 | 9/2001 | Warburton-Pitt et al. | |
| 6,458,106 | B1 | 10/2002 | Meier et al. | |
| 7,041,083 | B2 | 5/2006 | Chu et al. | |
| 9,095,502 | B2 * | 8/2015 | Williams | A61J 15/0015 |
| 2009/0318897 | A1 | 12/2009 | Bailey et al. | |
| 2012/0089128 | A1 | 4/2012 | Rotella et al. | |
| 2012/0296254 | A1 | 11/2012 | Swain et al. | |
| 2018/0177993 | A1 * | 6/2018 | Fitzgerald | A61J 15/0026 |

OTHER PUBLICATIONS

PCT International Search and Written Opinion of the International Searching Authority for Report corresponding PCT/US2018/059224, dated Jan. 30, 2019, pp. 1-13.

* cited by examiner

*Primary Examiner* — Deanna K Hall
(74) *Attorney, Agent, or Firm* — Tucker Ellis LLP; Heather M. Barnes

(57) ABSTRACT

One or more techniques and/or systems are disclosed for a gastrojejunostomy tube (G-J tube) with a replaceable balloon portion. An example G-J tube can comprise a connection point that is appropriately disposed distally from the balloon portion. The connection can be used to detach a proximal portion from a distal portion of the G-J tube; and a replacement proximal portion can be attached, and the G-J tube can be moved to the desired location. The example G-J tube can comprise a jejunal tube, a gastric tube, and a balloon tube, respectively sized to dispose the distal opening in an appropriate location in the target patient. The proximal portion can comprise at least the balloon tube, the port of the gastric tube, and the port of the jejunal tube.

20 Claims, 7 Drawing Sheets

EXCHANGEABLE BALLOON GASTROJEJUNOSTOMY TUBE

CROSS-REFERENCE TO RELATED APPLICATIONS

This application claims priority to U.S. Provisional Patent Application Ser. No. 62/581,326, entitled EXCHANGEABLE BALLOON GASTROJEJUNOSTOMY TUBE, filed Nov. 3, 2017, which is incorporated herein by reference.

BACKGROUND

Gastrojejunostomy (G-J) tubes are devices that allow patients to have enteral nutrition provided directly into their small bowel. They are typically used in patients who do not tolerate gastric feeding well, usually resulting from a gastric motility disorder. A G-J tube, which is often placed by either a surgeon, gastroenterologist, or an interventional radiologist, is commonly a long tube with three separate compartments: gastric tube, jejunal tube, and balloon. The gastric tube can serve to decompress the stomach, a balloon port extends to the balloon to allow for inflation and deflation of the balloon, and the jejunal tube can provide feeding access. The G-J tube typically enters the abdomen like a gastrostomy tube, except the distal end of the tube can extend in the jejunum.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

One or more techniques and systems are described herein for a gastrojejunostomy tube (G-J tube) with a replaceable balloon portion. That is, for example, instead of removing a G-J tube from a patient, and replacing the entire G-J tube with a new one, merely the balloon portion may be detached and replaced. Such a device can comprise a connection point that is appropriately disposed distally from the balloon portion, which is used to detach a proximal portion from a distal portion of the G-J tube. A replacement proximal portion can be attached, and the G-J tube can be moved to the desired location.

In one implementation of gastrojejunostomy tube, a jejunal tube can comprise a port at a proximal end and an opening at a distal end. The jejunal tube can be sized to dispose the opening at the distal end in a jejunum of a target patient. Further in this implementation, a gastric tube can comprise a port at a proximal end and an opening at a distal end. The gastric tube can be sized to dispose the opening at the distal end in a stomach of the target patient; and the gastric tube can be operably, fixedly coupled with the jejunal tube. Additionally, a balloon tube can comprise a port at a proximal end and balloon at a distal end. The balloon tube can be sized to dispose the balloon in the stomach of the target patient; and the balloon tube can be operably, fixedly coupled with the jejunal tube. In this implementation, the gastrojejunostomy tube can comprise a proximal portion and a distal portion. The proximal portion can be selectably detachable from the distal portion such that the distal portion remains in the target patient and the proximal portion is removed from the patient. The proximal portion can comprise the balloon tube, the port of the gastric tube, and the port of the jejunal tube. A replacement proximal portion of the gastrojejunostomy tube can be selectably, attached to the distal portion remaining in the target patient.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

DETAILED DESCRIPTION

Figure 1:
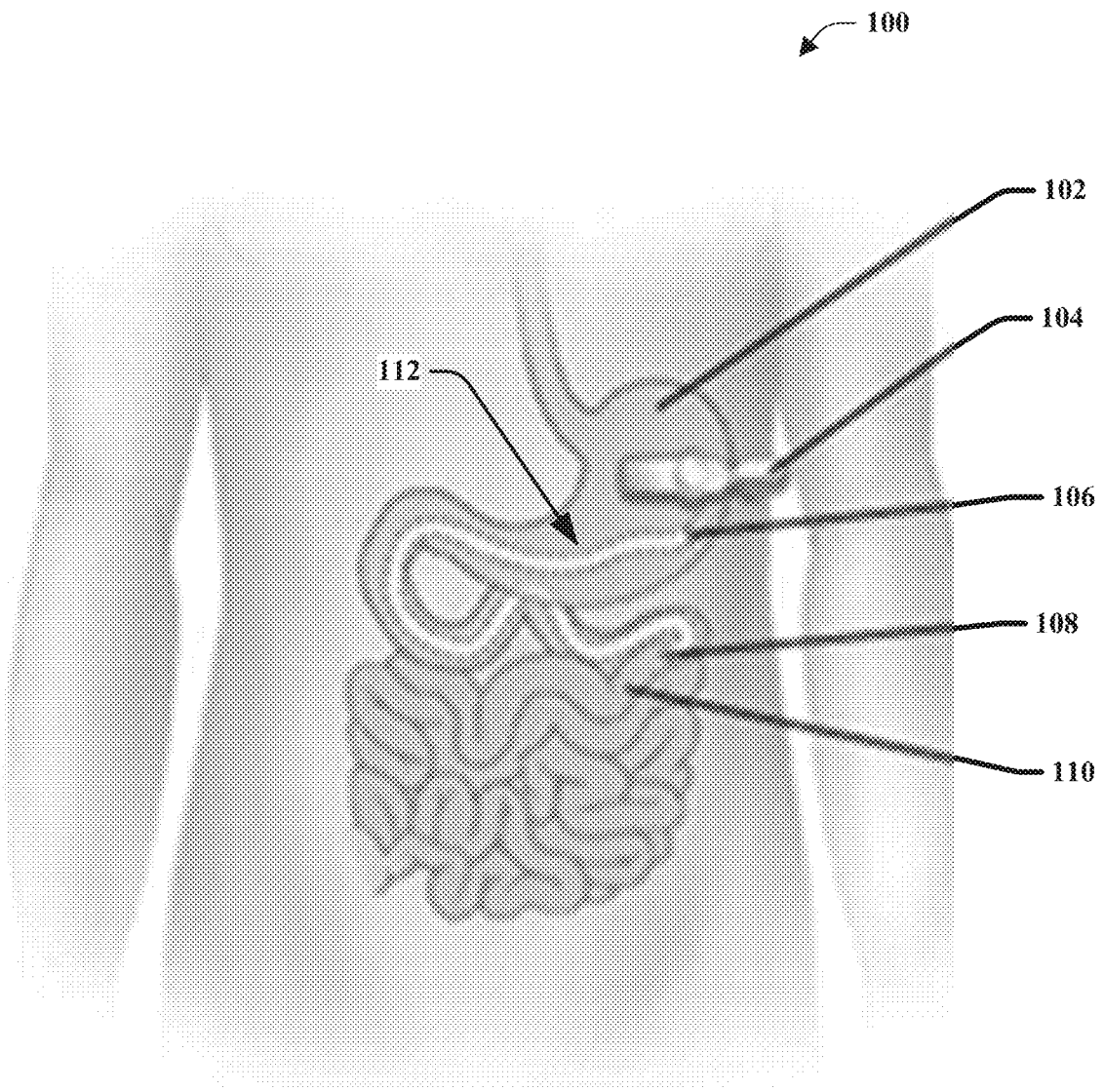
FIG. 1 is a component diagram illustrating an example implementation of a gastrojejunostomy tube that can be separated into proximal and distal portions.
Figure 2A:
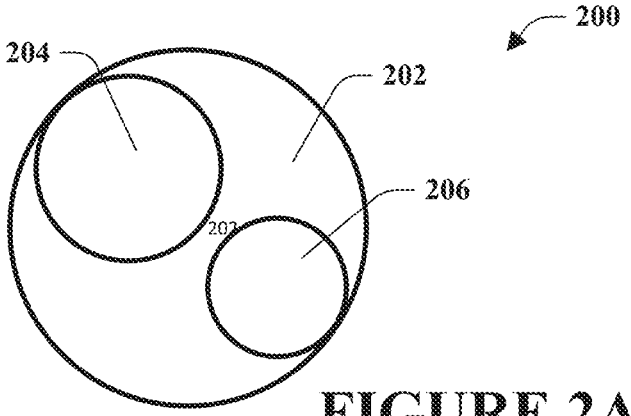
FIGS. 2A, 2B, and 2C are component diagrams illustrating various implementations of one or more portions of one or more systems described herein.
Figure 2B:
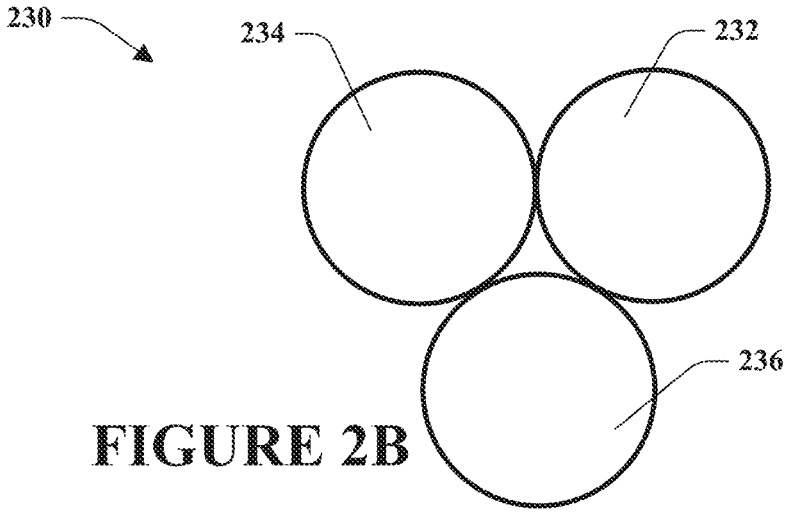
Figure 2C:
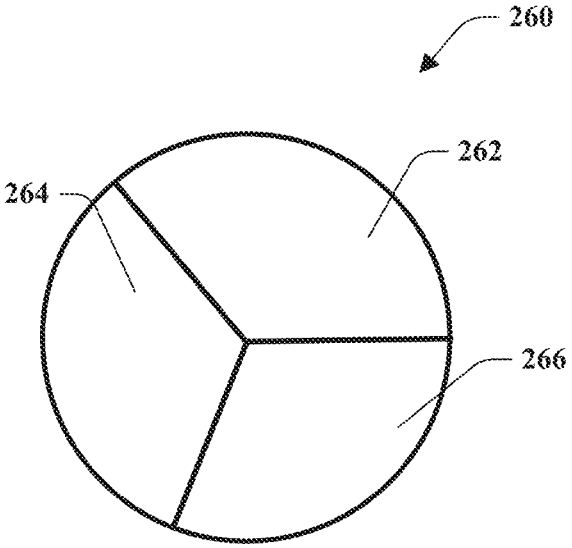

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

In one aspect, a G-J tube can be devised that allows for removal and replacement of a balloon portion of the G-J tube, without removal of the entire G-J tube from the target patient. In this aspect, for example, a G-J tube can be devised for insertion through an access opening (e.g., stoma site) formed in the abdomen wall and stomach wall of a target patient. In one aspect, removal and replacement of the balloon portion of the G-J tube can be performed by a health care provider or caregiver. A patient would not need to undergo anesthesia to undergo the removal and replacement procedure. In this example, the G-J tube can be installed with the distal end disposed at the jejunum of the target patient, and the proximal end disposed outside of abdomen wall of the target patient, proximate the access opening. Further, a balloon port of the G-J tube can be used to inflate a balloon inside the target patient's stomach, to facilitate securing (e.g., at least temporarily) the G-J tube at a desired position. For example, the balloon can be inflated against the stomach wall, proximate the access opening, and hold the G-J tube in place in combination with a stop disposed outside the abdomen wall.

In this aspect, as an example, the balloon that was inflated inside the target patient's stomach may lose integrity and deflate, which can result in the G-J tube displacing from the desired location. In this example, a balloon that can no longer be used to hold the G-J tube at the desired location should be replaced. In order to replace the balloon, with prior G-J tubes, the entire tube is removed, and a new tube is inserted at the desired location. For example, G-J tubes are typically replaced using x-ray guidance, such as in a radiology department, to ensure that both the distal end of the gastric tube and the distal end of the jejunal tube are disposed in the desired location. Therefore, in this example, every few months, the target patient may be subjected to x-rays during replacement of a G-J tube, and an uncomfortable procedure, in order to replace a damaged balloon.

FIGS. 1, 2A, 2B, 2C, 3A, 3B, and 3C are component diagrams illustrating various implementations of an example G-J tube. In one implementation, in this aspect, a G-J tube 112, 200, 230, 260, 300, as described herein, may comprise a jejunal tube 202, 232, 262 comprising a port 306 at a proximal end 302 and an opening 108, 318 at a distal end 320. The jejunal tube 202 can be sized (e.g., having a desired length) to dispose the opening 318 at the distal end 320 in a jejunum 110 of a target patient. In this implementation, the jejunal tube 202, 232, 262 portion of the G-J tube 112, 200, 230, 260, 300 has a port 306 that is configured to be disposed outside 350 of the target patient, proximate an opening in the target patient's abdomen. The jejunal port 306 can be used to introduce products (e.g., nutrition, water, medicine, etc.) into the jejunal tube 202, 232, 262; and the jejunal opening 318 at the distal end 320 can allow the introduced products to enter the jejunum 110 of the target patient. Further, for example, each patient can be of a different size, and a distance between the access opening in the target patient's abdomen and the jejunum 110 can also be different in length. Therefore, in this example, the jejunal tube 202, 232, 262 can be sized (e.g., having a desired length) to allow the port 306 to be disposed outside the abdomen 350, and the distal opening 318 to be appropriately disposed in the jejunum 110.

In this implementation, the G-J tube 112, 200, 230, 260, 300 can comprise a gastric tube 204, 234, 264, which comprises a port 308 at a proximal end 302 and an opening 316 at a distal end 320. In this implementation, the gastric tube 204, 234, 264 can be sized to dispose the opening 316 at the distal end 320 in a stomach 102 of the target patient. The gastric tube 204, 234, 264 can be operably, fixedly coupled with the jejunal tube 202, 232, 262. For example, the gastric tube 204, 234, 264 can be fixed to the jejunal tube 202, 232, 262 such that the respective tubes can be readily inserted into a target patient together, with one motion. As an example, as in FIG. 2B, the gastric tube 234 can be joined side-by-side with the jejunal tube 232; the gastric tube 264 and the jejunal tube 262 may comprise separate chambers of larger tube 260, as in FIG. 2C; or the gastric tube 204 may comprise a separate chamber disposed inside the jejunal tube 202 (e.g., or vice versa), as in 200 of FIG. 2A.

In this implementation, the gastric tube 204, 234, 264 portion of the G-J tube has a proximal port 308 that is configured to be disposed outside 350 of the target patient, proximate the opening in the target patient's abdomen. The gastric port 308 can be used to introduce products (e.g., nutrition, water, medicine, etc.) into the gastric tube 204, 234, 264; and the gastric opening 316 at the distal end 320 can allow the introduced products to enter the stomach 102 of the target patient. As another example, the gastric port 308 can be used to decompress the stomach by draining (e.g., actively using a pump, or passively by opening the port) gas, fluid or other substances from the stomach. Further, for example, as each patient may be differently sized, the gastric tube 204, 234, 264 can also have different lengths to accommodate appropriately, such that the proximal gastric port 308 is disposed outside 350 the abdomen, and the distal gastric opening 316 is disposed in the stomach 352 of the target patient.

In this implementation, the G-J tube 112, 200, 230, 260, 300 can comprise a balloon tube 206, 236, 266 that comprises a port 310 at a proximal end 302 and balloon 312 at a distal end 320. The balloon tube 206, 236, 266 can be sized to dispose the balloon 312 in the stomach 102 of the target patient. Further, the balloon tube 206, 236, 266 can be operably, fixedly coupled with the jejunal tube 202, 232, 262. As an example, the balloon tube 206, 236, 266 can be fixed to the jejunal tube 202, 232, 262 such that the respective tubes (e.g., jejunal, gastric and balloon) can be readily inserted into the target patient together, with one motion. As an example, the balloon tube 236 can be joined side-by-side with the jejunal tube 232; the balloon tube 266 and the jejunal tube 262 may comprise separate chambers of larger tube 260; or the balloon tube 206 may comprise a separate chamber disposed inside the jejunal tube 202 (e.g., or vice versa).

In this implementation, the balloon tube 206, 236, 266 portion of the G-J tube 112, 200, 230, 260, 300 has a proximal port 310 that is configured to be disposed outside 350 of the target patient, proximate the opening in the target patient's abdomen. The balloon port 310 can be used to introduce gas (e.g., air) into the balloon tube 206, 236, 266, which, in turn, can inflate the attached balloon 312 at the distal end of the balloon tube 206, 236, 266, in the patient's stomach 102. As an example, inflating the balloon 312 in the patient's stomach can provide for the G-J tube 300 to be appropriately secured inside the patient, as the balloon 312 mitigates movement of the G-J tube 300 to the outside of the patient. In one implementation, a disk or other type of fastener can be secured on the G-J tube outside of the abdomen, to mitigate movement of the G-J tube to the inside of the patient. The balloon port 310 can be used to remove gas (e.g., air) from the balloon 312, to deflate the balloon 312, through the balloon tube 206, 236, 266, which may allow for removal of the G-J tube 300 from inside 352 the patient's stomach.

In this implementation, the G-J tube 300 can comprise a proximal portion 302 and a distal portion 320. The proximal portion 302 is selectably detachable from the distal portion 320 such that the distal portion 320 remains in the target patient 352 and the proximal portion 302 is removed from the patient. Further, the proximal portion 302 comprises the balloon tube 206, 236, 266, the port 308 of the gastric tube, and the port 306 of the jejunal tube, which may be respectively disposed in a port component 104, 304. For example, when it is time to replace the balloon 312 of the G-J tube 300 installed in a patient (e.g., the balloon is damaged, loses integrity, deflates, etc.) the proximal portion 302 can be detached from the distal portion 320. In this implementation, a replacement proximal portion of the gastrojejunostomy tube can be selectably, attached to the distal portion 320 remaining in 352 the target patient. That is, for example, the replacement proximal portion can be attached to the distal portion 320 while it remains inside the target patient.

In one implementation, the distal portion 320 can comprise the distal portion of the jejunal tube, comprising the opening 318. In this way, for example, at least the jejunal tube portion 318 of the G-J tube 300 can remain inside the patient 352. This can mitigate the use of x-ray assisted insertion, as the jejunal tube portion can be merely moved back into its desired location after the replacement proximal portion is attached. In another implementation, the distal portion 320 of the G-J tube 300 can comprise the distal portion of the gastric tube, comprising the gastric opening 316. In this way, at least the distal portion 320 of both the jejunal tube portion 318 and the gastric tube portion 316 of the G-J tube 300 can remain inside the patient during replacement of the proximal portion. As one example, the proximal portion 302 can comprise the balloon tube 306, 336, 366, including the balloon port 310 and balloon 312. In this example, merely the balloon tube 306, 336, 366 is detached from the distal portion 320, as in FIG. 3A, and a replacement balloon tube can be attached to the distal portion 320. In this example, the attached, new balloon tube can be reinserted through the access opening, and the balloon can be inflated to hold the G-J tube in the desired location.

In one implementation, the G-J tube 300 described herein, can comprise a connection 314 that is disposed between the proximal portion 302 and the distal portion 320 of the gastrojejunostomy tube 300. In this implementation, the connection can provide a secure, fluid coupling between the proximal portion 302 and the distal portion 320. As an example, the connection 314 can comprise a type of leur lock design, an S-connector, a quick connector, or some other connection that can be used to fluidly couple tubes together in a suitable connection, inside a patient. That is, for example, the connection 314 can comprise two portions that are respectively, operably engaged with either the proximal portion 302 of the G-J tube 300, or the distal portion 320 of the G-J tube 300. In this example, the respective portions of the connection 314 can be selectably, fixedly engaged with each other to form the fluid coupling (e.g., substantially leak-free) between the portions of the G-J tube 300.

Figure 3A:
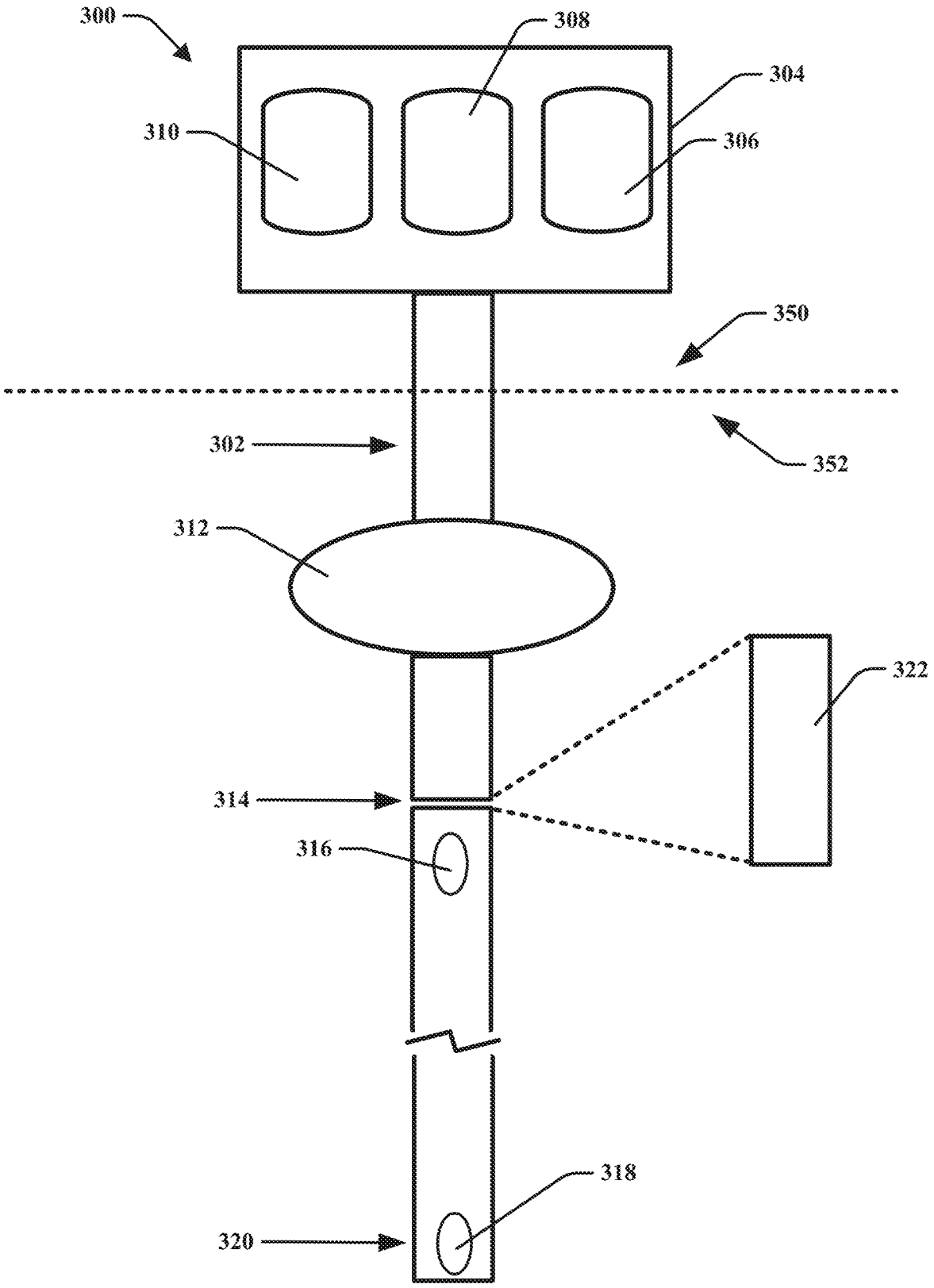
FIGS. 3A, 3B, and 3C are component diagrams illustrating various implementations of one or more portions of one or more systems described herein.
Figure 3B:
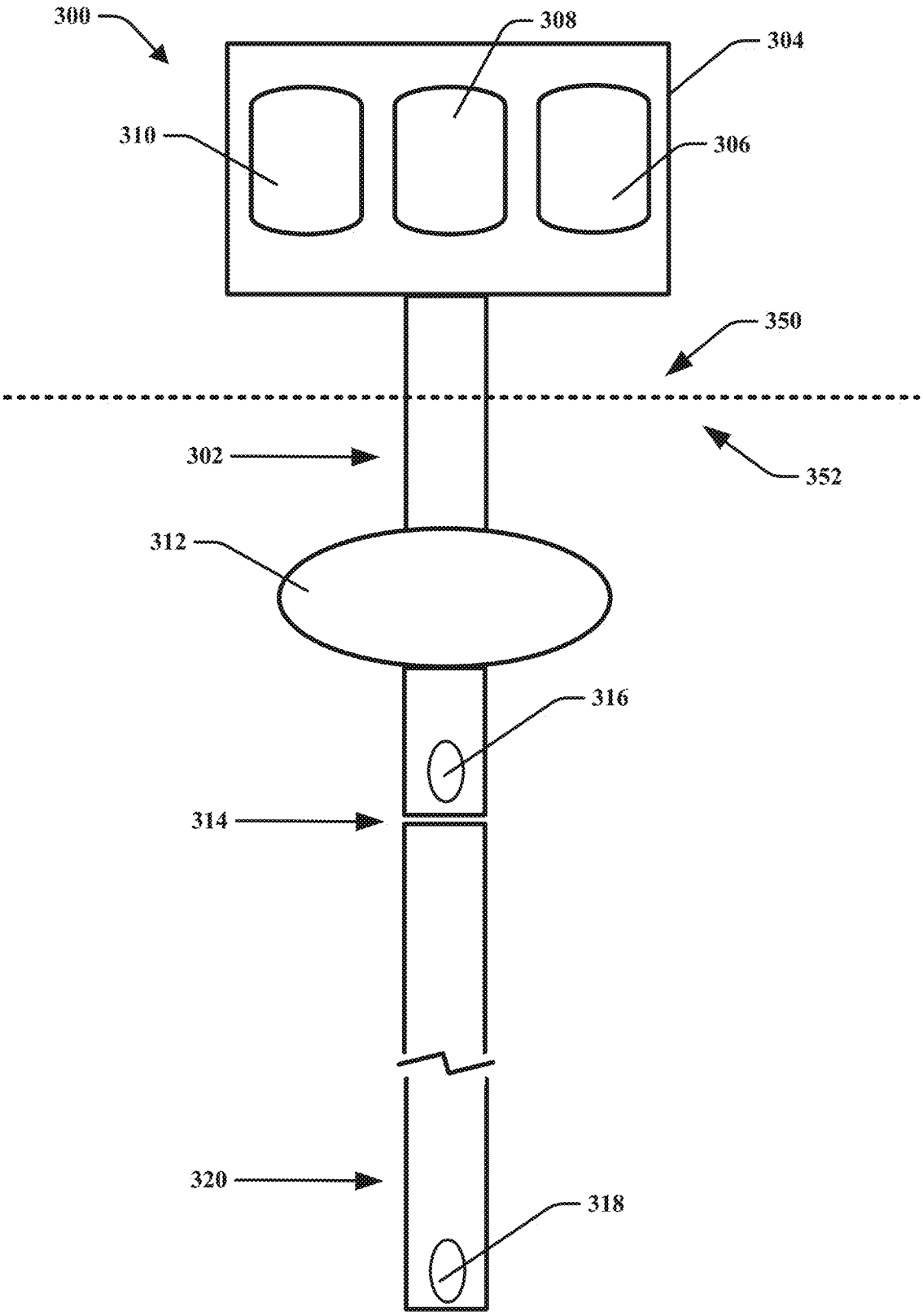

In one implementation, the connection 314 can be disposed distally from the balloon 312 and proximally from the opening 316 at the distal end of the gastric tube, as in FIG. 3A. That is, for example, the connection 314 point is between the balloon 312 and distal opening 316 of the gastric tube. In this example, the proximal portion 302 can comprise the balloon tube 206, including the balloon 312 and balloon port 310, the gastric port 308, and the jejunal port 306, disposed in the port component 104, 304. In this example, the distal portion 320 of the G-J tube 300 can comprise the distal portion 316 of the gastric tube and the distal portion 318 of the jejunal tube. In one implementation, as in FIG. 3B, the connection 314 can be disposed distally from the distal end of the gastric tube 316 and proximally from the opening 318 at the distal end of the jejunal tube. That is, for example, the connection 314 point is disposed between the gastric tube 204 and distal portion 318 of the jejunal tube. In this example, the proximal portion 302 comprises the balloon tube 306, gastric tube 304, and jejunal port 306; and the distal portion 320 of the G-J tube comprises the distal portion 318 of the jejunal tube.

Figure 3C:
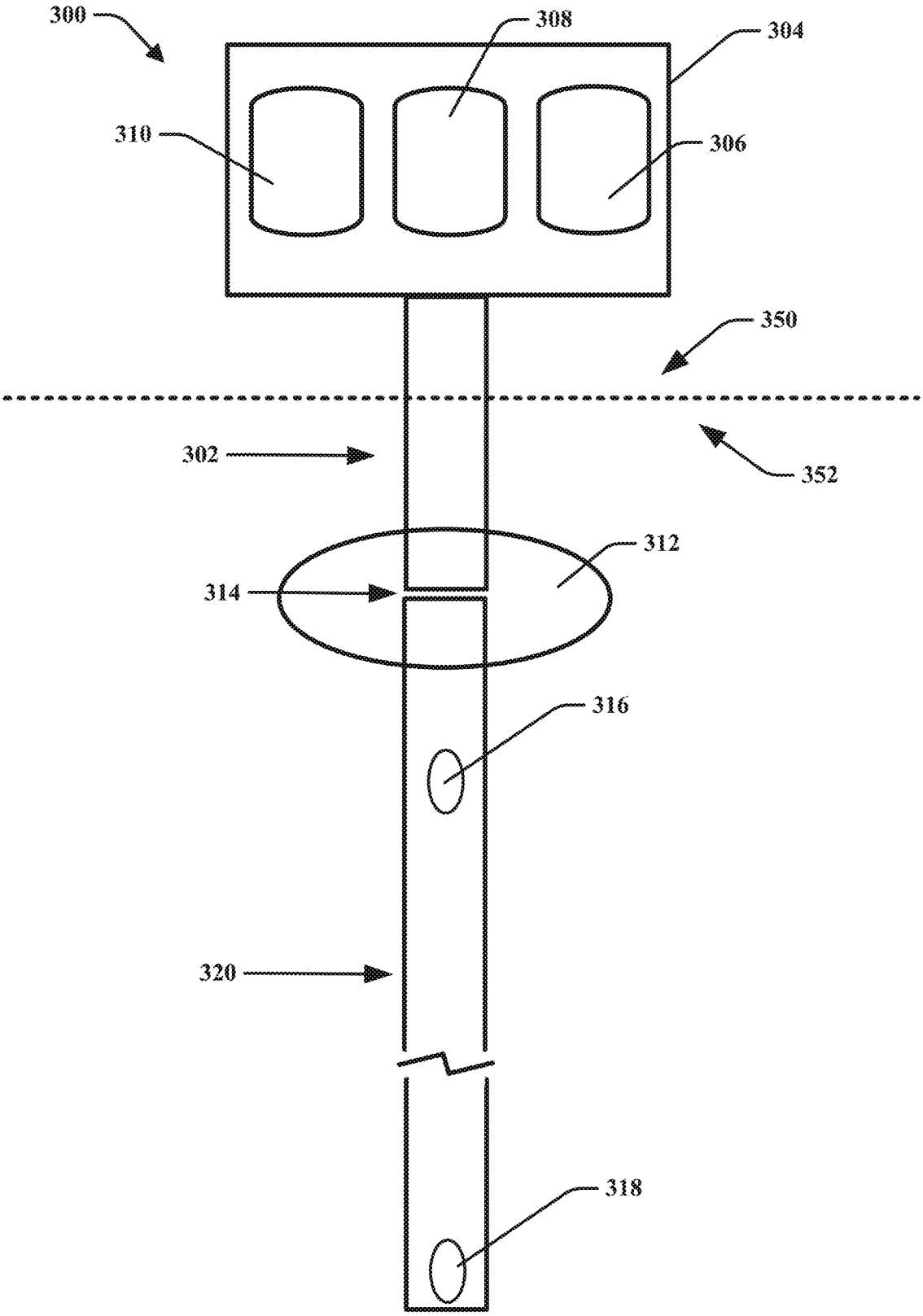

In one implementation, the connection 314 can be disposed within an inner lumen of the balloon 312, as in FIG. 3C. That is, for example, the connection 314 can be formed such that the connection 314 point is not exposed to the stomach 102. In this implementation, the connection portions that couple together to form the fluid coupling may not be exposed to stomach fluids that may compromise the integrity of the connection components (e.g., break down due to exposure to acids).

In one implementation, the G-J tube 112, 300 can comprise one or more extension tubes 322. In this implementation, the extension tube 322 can comprise a portion of the jejunal tube. In this implementation, the extension tube 322 can be sized (e.g., lengthwise) to extend the distance between the port 306 and the opening 318 of the jejunal tube. In one example, the extension tube 322 may comprise at least a portion of the gastric tube, to extend the distance between the gastric port 308 and gastric opening 316. Further, the extension tube can be selectably attachable to the G-J tube 300 between the proximal portion 302 and a distal portion 320 of the G-J tube 300. That is, for example, the length of the jejunal tube 202 can be adjusted by attaching or removing an extension tube 322 to the jejunal tube portion of the G-J tube at the connection 314. As an example, the extension tube 322 can comprise a coupling portion that complements one of the portions of the connection 314, to selectably, fixedly attach to the G-J tube 300 to form a fluid coupling.

Figure 4:
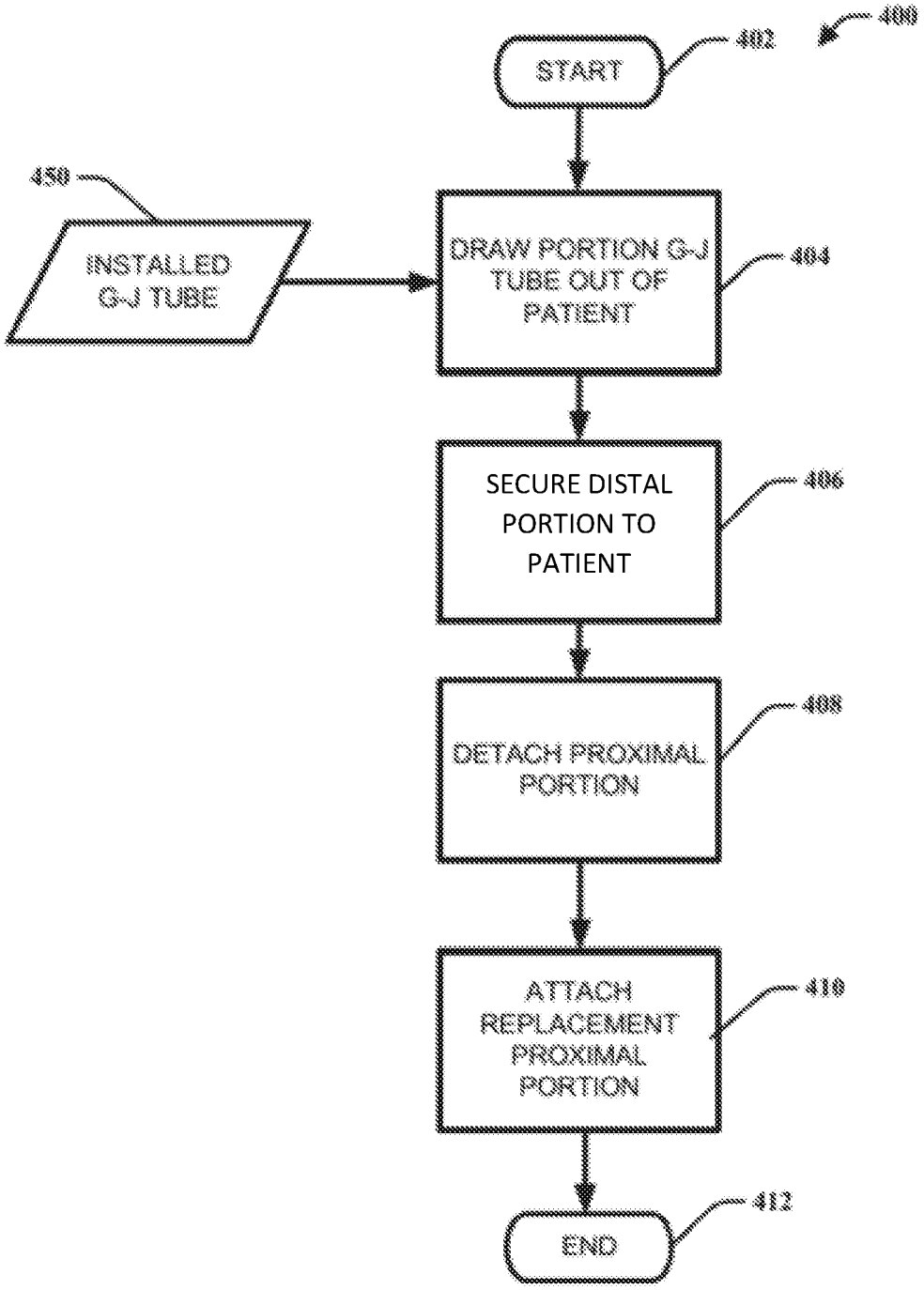
FIG. 4 is a flow diagram illustrating an example implementation of an example method for using a gastrojejunostomy tube.

A method may be devised for using a gastrojejunostomy tube (G-J tube). That is, for example, a method can be devised for using the G-J tube described herein. FIG. 4 is a flow diagram illustrating an example implementation of an example method 400 for using a gastrojejunostomy tube. The exemplary method 400 begins at 402. At 404, a portion of a G-J tube 450 installed in a patient can be drawn from the target patient. In this implementation, the G-J tube can comprise: a jejunal tube comprising a port at a proximal end and an opening at a distal end, and sized to dispose the opening at the distal end in a jejunum of the target patient; a gastric tube comprising a port at a proximal end and an opening at a distal end, and sized to dispose the opening at the distal end in a stomach of the target patient, the gastric tube operably, fixedly coupled with the jejunal tube; and a balloon tube comprising a port at a proximal end and balloon at a distal end, and sized to dispose the balloon in the stomach of the target patient, the balloon tube operably, fixedly coupled with the jejunal tube. Further, in this implementation, the gastrojejunostomy tube can comprise a proximal portion and a distal portion with a connection disposed therebetween, the proximal portion can be selectably detachable from the distal portion at the connection, and the proximal portion can comprise the balloon tube, the port of the gastric tube, and the port of the jejunal tube.

In this exemplary method, at 406, the distal portion of the gastrojejunostomy tube can be secured to the patient such that the connection is accessible. That is, for example, the G-J tube 450 can be drawn (e.g., pulled) out of the patient at least to a point where a clinician (e.g., or other qualified person) can access the connection to appropriately detach the proximal portion from the distal portion. Further, for example, the distal portion can be secured to the patient, such as using a clamp, fastener, tape, or other suitable device, so that the distal portion does not go back into the patient at least until a replacement proximal portion is attached.

In one implementation, the drawing of the portion of the gastrojejunostomy tube from the target patient can comprise drawing the gastrojejunostomy tube to expose the connection. In one implementation, the connection can be disposed distally from the balloon and proximally from the opening at the distal end of the gastric tube; distally from the distal end of the gastric tube and proximally from the opening at the distal end of the jejunal tube; or within an inner lumen of the balloon.

In this exemplary method, at 408, the proximal portion can be detached from the distal portion at the connection of the G-J tube 450. That is, for example, the two portion of the connection can be uncoupled to detach the proximal portion from the distal portion. As one example, using a leur lock, one portion can be unscrewed from the other portion; using a quick connector, one portion can be decoupled by deactivating the locking mechanism, from the other portion. In one implementation, detaching of the proximal portion from the distal portion at the connection can comprise detaching the proximal portion that comprises the gastric tube. In one implementation, detaching of the proximal portion from the distal portion at the connection can comprise detaching at the connection wherein the connection is disposed within an inner lumen of the balloon.

In this exemplary method, at 410, a replacement proximal portion can be attached to the distal portion at the connection while the distal portion remains in the target patient. That is, for example, a connection portion on the replacement proximal portion can be coupled to the other portion of the connection on the distal portion. Having attached the replacement proximal portion, the exemplary method 400 ends at 412.

In one implementation, after the replacement proximal portion is attached, the G-J tube can be reinserted into the target patient, at least to the desired location. Further, in one implementation, the balloon of the replacement proximal portion can be inflated using the balloon port, to secure the gastrojejunostomy tube in the target patient. As one example, a replacement disk or other fastener can be installed on the G-J tube outside of the abdomen, at the access port, to help secure the G-J tube in position.

In one implementation, a method of using a G-J tube can comprise selectably attaching an extension tube to the gastrojejunostomy tube between the proximal portion and a distal portion. In this implementation, the extension tube can comprise a portion of the jejunal tube, and the extension tube can be sized (e.g., lengthwise) to extend the distance between the port and the opening of the jejunal tube. In one implementation, the method of using a G-J tube can comprise selectably attaching an extension tube wherein the extension tube comprises a portion of the gastric tube, and wherein the extension tube is sized to extend the distance between the port and the opening of the gastric tube. That is, for example, the extension tube can be used to extend the length of the jejunal tube and/or the gastric tube.

Figure 5:
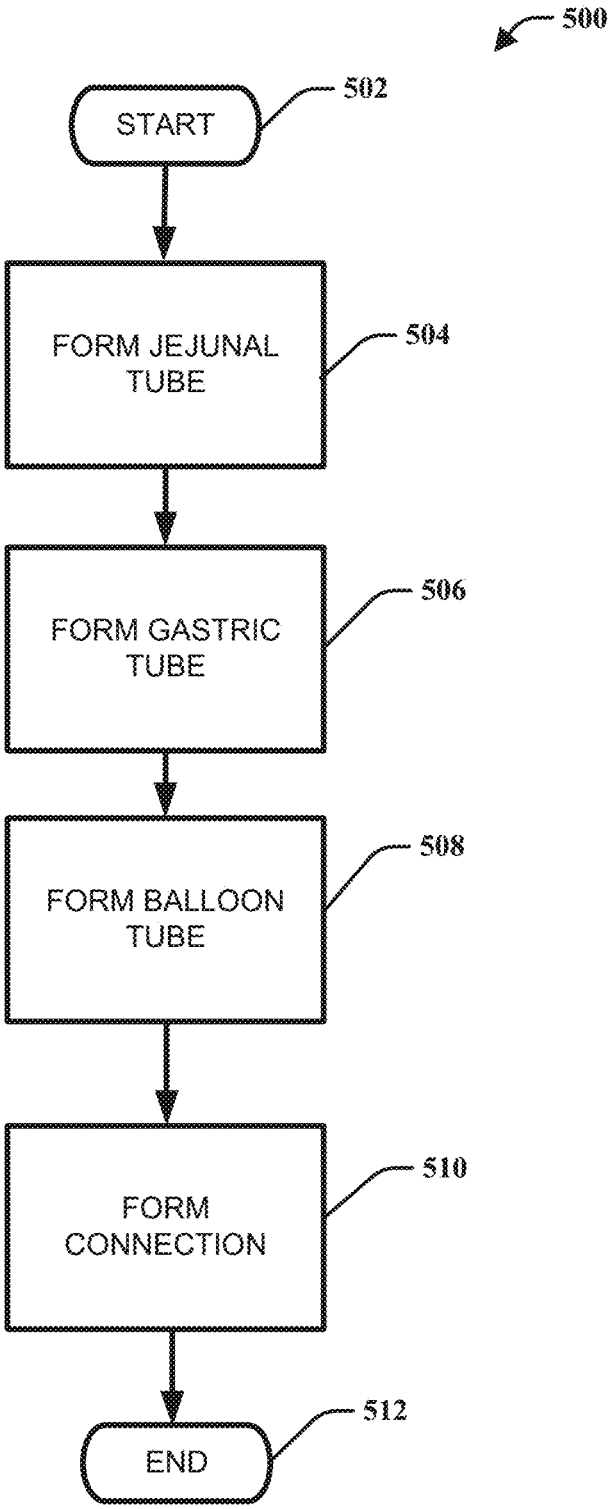
FIG. 5 is a flow diagram illustrating an example implementation of an example method for manufacturing a gastrojejunostomy tube.

A method of manufacturing a gastrojejunostomy tube (G-J tube) can be devised. FIG. 5 is a flow diagram illustrating an example implementation of an example method 500 for manufacturing a gastrojejunostomy tube. The exemplary method 500 begins at 502. At 504, manufacturing the G-J tube can comprise forming a jejunal tube that comprises a port at a proximal end and an opening at a distal end. In this implementation, the jejunal tube can be sized to dispose the opening at the distal end in a jejunum of a target patient. Further, in this exemplary method, at 504, a gastric tube can be formed that comprises a port at a proximal end and an opening at a distal end. The gastric tube can be sized to dispose the opening at the distal end in a stomach of the target patient. Additionally, the gastric tube can be formed to be operably, fixedly coupled with the jejunal tube.

In this implementation of the exemplary method of manufacture, at 506, a balloon tube can be formed that comprises a port at a proximal end and balloon at a distal end. The balloon tube can be sized to dispose the balloon in the stomach of the target patient. Further, the balloon tube can be formed to be operably, fixedly coupled with the jejunal tube. Additionally, the G-J tube can be formed with a proximal portion and a distal portion. In this implementation, the proximal portion can be formed to be selectably detachable from the distal portion such that the distal portion can remain in the target patient and the proximal portion can be removed from the patient. The proximal portion can also be formed to comprise the balloon tube, the port of the gastric tube, and the port of the jejunal tube. In this implementation, the G-J tube can be formed such that a replacement proximal portion of the G-J tube can be selectably, attached to the distal portion remaining in the target patient.

In one implementation, at 510 of the exemplary method of manufacture, a connection can be formed between the proximal portion and a distal portion of the gastrojejunostomy tube. In this implementation, the connection can provide a secure, fluid coupling between the proximal portion and a distal portion. In one implementation, the forming of the connection can comprise disposing the connection: distally from the balloon and proximally from the opening at the distal end of the gastric tube; distally from the distal end of the gastric tube and proximally from the opening at the distal end of the jejunal tube; or within an inner lumen of the balloon.

In one implementation, the exemplary method of manufacture can comprise forming an extension tube that comprises a portion of the jejunal tube. In this implementation, the extension tube can be selectably attachable to the gastrojejunostomy tube between the proximal portion and a distal portion of the gastrojejunostomy tube. Further, the extension tube can be sized to extend the distance between the port and the opening of the jejunal tube.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, At least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

Furthermore, the claimed subject matter may be implemented as a method, apparatus or article of manufacture using standard programming and/or engineering techniques to produce software, firmware, hardware or any combination thereof to control a computer to implement the disclosed subject matter. The term "article of manufacture" as used herein is intended to encompass a computer program accessible from any computer-readable device, carrier or media. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure. In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A gastrojejunostomy tube, comprising:

a jejunal tube comprising a port at a proximal end and an opening at a distal end, and sized to dispose the opening at the distal end in a jejunum of a target patient;

a gastric tube comprising a port at a proximal end and an opening at a distal end, and sized to dispose the opening at the distal end in a stomach of the target patient, the gastric tube operably, fixedly coupled with the jejunal tube; and a balloon tube comprising a port at a proximal end and balloon at a distal end, and sized to dispose the balloon in the stomach of the target patient, the balloon tube operably, fixedly coupled with the jejunal tube;

wherein the gastrojejunostomy tube comprises a proximal portion and a distal portion, the proximal portion being selectably detachable from the distal portion and replaceable such that the distal portion of the gastrojejunostomy tube comprising the distal end of the jejunal tube remains in the target patient and the proximal portion is removed from the target patient, the proximal portion comprising the balloon tube, the port of the gastric tube, and the port of the jejunal tube; and wherein a replacement proximal portion of the gastrojejunostomy tube can be selectably, attached to the distal portion remaining in the target patient.

2. The gastrojejunostomy tube of claim 1, comprising a connection disposed between the proximal portion and the distal portion of the gastrojejunostomy tube, the connection disposed inside the target patient and providing a secure, fluid coupling between the proximal portion and the distal portion.

3. The gastrojejunostomy tube of claim 2, the connection disposed at one of:

distally from the balloon and proximally from the opening at the distal end of the gastric tube;

distally from the distal end of the gastric tube and proximally from the opening at the distal end of the jejunal tube; or within an inner lumen of the balloon.

4. The gastrojejunostomy tube of claim 1, the proximal portion of the gastrojejunostomy tube comprising the gastric tube.

5. The gastrojejunostomy tube of claim 1, at least a portion of the gastric tube disposed internally in the jejunal tube.

6. The gastrojejunostomy tube of claim 1, at least a portion of the balloon tube disposed internally in the jejunal tube.

7. The gastrojejunostomy tube of claim 1, comprising an extension tube comprising a portion of the jejunal tube, the extension tube selectably attachable to the gastrojejunostomy tube between the proximal portion and the distal portion of the gastrojejunostomy tube, the extension tube sized to extend the distance between the port and the opening of the jejunal tube.

8. The gastrojejunostomy tube of claim 7, the extension tube comprising a portion of the gastric tube, the extension sized to extend the distance between the port and the opening of the gastric tube.

9. A method for using a gastrojejunostomy tube, comprising:

drawing a portion of the gastrojejunostomy tube from a target patient, the gastrojejunostomy tube comprising:

a jejunal tube comprising a port at a proximal end and an opening at a distal end, and sized to dispose the opening at the distal end in a jejunum of the target patient;

a gastric tube comprising a port at a proximal end and an opening at a distal end, and sized to dispose the opening at the distal end in a stomach of the target patient, the gastric tube operably, fixedly coupled with the jejunal tube; and a balloon tube comprising a port at a proximal end and balloon at a distal end, and sized to dispose the balloon in the stomach of the target patient, the balloon tube operably, fixedly coupled with the jejunal tube;

wherein the gastrojejunostomy tube comprises a proximal portion and a distal portion with a connection disposed therebetween, the proximal portion being selectably detachable from the distal portion at the connection and replaceable, and the proximal portion comprises the balloon tube, the port of the gastric tube, and the port of the jejunal tube;

securing the distal portion of the gastrojejunostomy tube to the target patient such that the connection is accessible;

detaching the proximal portion from the distal portion at the connection; and attaching a replacement proximal portion to the distal portion at the connection while the distal portion of the gastrojejunostomy tube comprising the distal end of the jejunal tube remains in the target patient.

10. The method of claim 9 comprising, reinserting the gastrojejunostomy tube into the target patient.

11. The method of claim 10 comprising, inflating a replacement balloon using the balloon port to secure the gastrojejunostomy tube in the target patient.

12. The method of claim 9, the drawing the portion of the gastrojejunostomy tube from the target patient comprising drawing the gastrojejunostomy tube to expose the connection, wherein the connection is disposed at one of:

distally from the balloon and proximally from the opening at the distal end of the gastric tube;

distally from the distal end of the gastric tube and proximally from the opening at the distal end of the jejunal tube; or within an inner lumen of the balloon.

13. The method of claim 9, the detaching the proximal portion from the distal portion at the connection comprising detaching the proximal portion that comprises the gastric tube.

14. The method of claim 9, the detaching the proximal portion from the distal portion at the connection comprising detaching at the connection wherein the connection is disposed within an inner lumen of the balloon.

15. The method of claim 9, comprising selectably attaching an extension tube, comprising a portion of the jejunal tube, to the gastrojejunostomy tube between the proximal portion and the distal portion, wherein the extension tube is sized to extend the distance between the port and the opening of the jejunal tube.

16. The method of claim 15, selectably attaching an extension tube wherein the extension tube comprises a portion of the gastric tube, and wherein the extension tube is sized to extend the distance between the port and the opening of the gastric tube.

17. A method of manufacturing a gastrojejunostomy tube, comprising:

forming a jejunal tube that comprises a port at a proximal end and an opening at a distal end, and is sized to dispose the opening at the distal end in a jejunum of a target patient;

forming a gastric tube that comprises a port at a proximal end and an opening at a distal end, and is sized to dispose the opening at the distal end in a stomach of the target patient, wherein the gastric tube is formed to be operably, fixedly coupled with the jejunal tube; and forming a balloon tube that comprises a port at a proximal end and balloon at a distal end, and is sized to dispose the balloon in the stomach of the target patient, wherein the balloon tube is formed to be operably, fixedly coupled with the jejunal tube;

wherein the gastrojejunostomy tube is formed with a proximal portion and a distal portion, wherein the proximal portion is formed to be selectably detachable from the distal portion and replaceable such that the distal portion of the gastrojejunostomy tube comprising the distal end of the jejunal tube can remain in the target patient and the proximal portion can be removed from the target patient, and wherein the proximal portion is formed to comprise the balloon tube, the port of the gastric tube, and the port of the jejunal tube; and wherein the gastrojejunostomy tube is formed such that a replacement proximal portion of the gastrojejunostomy tube can be selectably, attached to the distal portion remaining in the target patient.

18. The method of claim 17, forming a connection between the proximal portion and the distal portion of the gastrojejunostomy tube, the connection providing a secure, fluid coupling between the proximal portion and the distal portion.

19. The method of claim 18, forming the connection comprising disposing the connection at one of:

distally from the balloon and proximally from the opening at the distal end of the gastric tube;

distally from the distal end of the gastric tube and proximally from the opening at the distal end of the jejunal tube; or within an inner lumen of the balloon.

20. The method of claim 17, comprising forming an extension tube that comprises a portion of the jejunal tube, the extension tube selectably attachable to the gastrojejunostomy tube between the proximal portion and the distal portion of the gastrojejunostomy tube, the extension tube sized to extend the distance between the port and the opening of the jejunal tube.

* * * * *